United States Patent [19]

Reuter et al.

[11] 4,198,806

[45] Apr. 22, 1980

[54] TRAVELLERS FOR TWISTING MACHINES

[75] Inventors: Rene F. Reuter; Thomas N. H. Welter, both of Luxembourg, Luxembourg

[73] Assignee: The Goodyear Tire & Rubber Company, Akron, Ohio

[21] Appl. No.: 884,926

[22] Filed: Mar. 9, 1978

[30] Foreign Application Priority Data

Jul. 29, 1977 [LU] Luxembourg ..... 77870

[51] Int. Cl.[2] ..... D01H 7/60

[52] U.S. Cl. ..... 57/125

[58] Field of Search ..... 57/119-126

[56] References Cited

U.S. PATENT DOCUMENTS

| | | | |
|---|---|---|---|
| 2,942,407 | 6/1960 | Morin | 57/125 |
| 2,961,826 | 11/1960 | Morin | 57/125 |
| 3,055,166 | 9/1962 | Morin | 57/125 |
| 3,257,791 | 6/1966 | Morin | 57/125 |
| 3,292,359 | 12/1966 | Morin | 57/125 |
| 3,302,383 | 2/1967 | Morin | 57/125 |
| 3,320,736 | 5/1967 | Morin | 57/125 |
| 3,332,225 | 7/1967 | Drisch et al. | 57/125 |
| 3,364,671 | 1/1968 | Morin | 57/125 |
| 3,373,557 | 3/1968 | Loveland | 57/125 X |
| 3,376,699 | 4/1968 | Rogers | 57/125 |

*Primary Examiner*—John Petrakes

*Attorney, Agent, or Firm*—R. S. Washburn

[57] ABSTRACT

A traveller useful for either Z- or S-twisting in an otherwise conventional twisting or spinning frame. The traveller is provided with a roller which has a cylindrical surface mounted for rotation about an axis which, when in operation, lies in a plane normal to the path of the traveller and which plane contains the axis of the associated spool. The axis of the roller cylindrical surface intersects the rotation axis of the spool at an angle of from 30 to 60 degrees and preferably between 45 and 60 degrees. The traveller, therefore, is independent of rotation direction. Specific length to diameter ratios are disclosed as are relations of roller diameter to thickness of threads and the like engaging the roller during operation.

6 Claims, 2 Drawing Figures

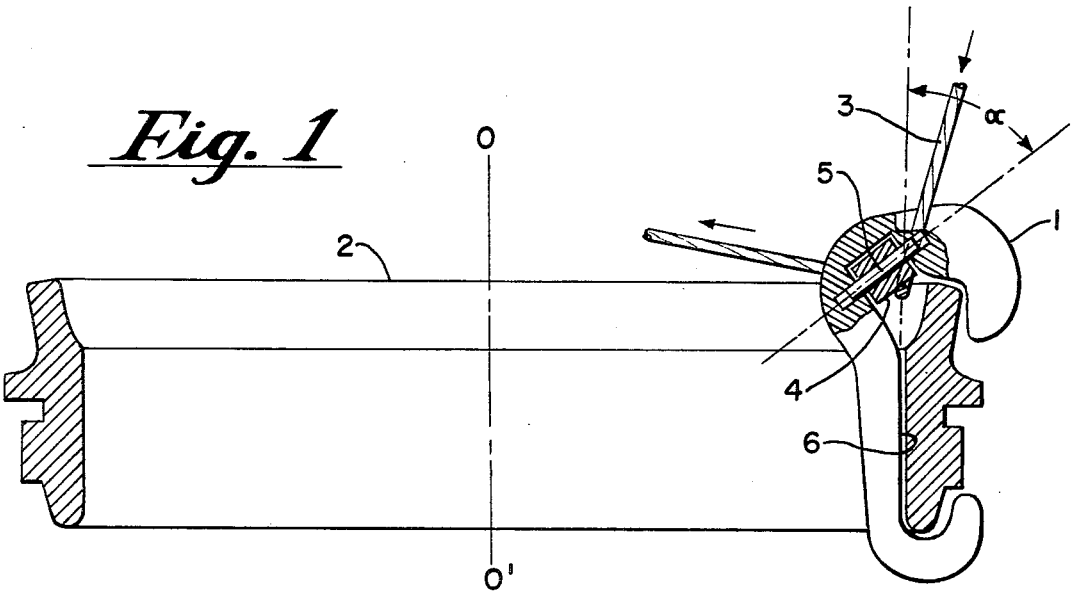
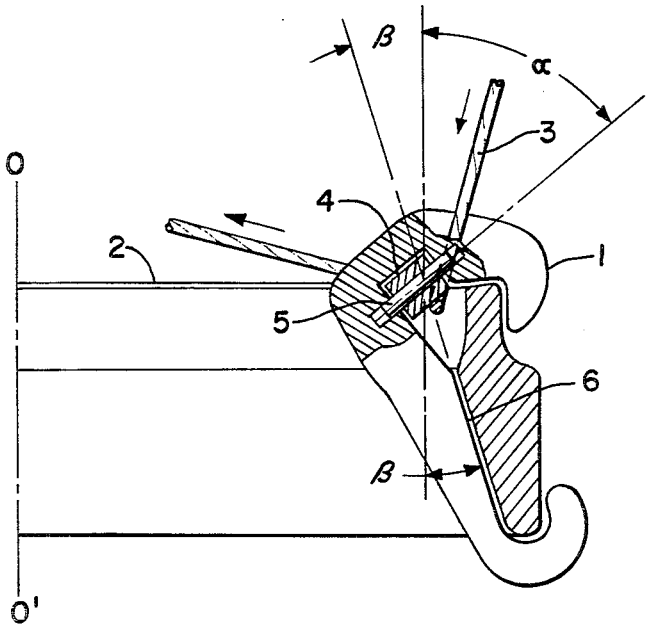
Fig. 2

TRAVELLERS FOR TWISTING MACHINES

This invention relates to improved roller travellers for the twisting of filaments, multifilament strands, cords, etc., on twisting frames; more particularly it deals with travellers suitable for the twisting of heavy threadlike elements in the range of 10,000 deniers and more and/or with rough surfaces.

The term "thread" as used in this description is intended to cover the properly so-called filaments as well as multifilaments, cords and/or other threadlike elements liable to be submitted to twisting or doubling; on the other hand, by the term "twisting" there is meant the twisting of threads initially substantially free from twist as well as the doubling of threads which have already been pre-twisted and therefore present a rougher surface.

It is known that a twisting frame comprises schematically in the top-to-bottom direction, feed rollers, a thread guide (pigtail), a traveller supported by a guide ring, the ring being coaxially mounted to a combined spool and spindle on which the thread to be twisted is wound after circumnavigating one hook end part of the travellerunder a so-called "seizure" angle.

Due to the friction between the thread and the traveller, the latter is driven in the thread travel direction along a circular path determined by the guide ring. In a conventional twisting operation, the linear speed of the traveller falls in the range of several tens of meters per second and its rotational speed, in the range of several thousands of revolutions per minute, which implies a relatively high centrifugal force. On the other hand, during the twisting operation, the traveller lags as compared to the spindle. In fact, its rotational speed is a function of the thread delivery speed which, in turn, is inversely proportional to the rate of twist expressed in number of twists per meter, produced by twisting in the final product.

One of the important functions of the traveller is to warrant for the thread a tension which is suitable for twisting or doubling.

A tension which is too strong can cause stretching and a generally unwanted inter-penetration of individual filaments. A tension which is too weak lowers the efficiency of the twisting and causes the formation of an exaggerated balloon and thus a mediocre stability in the space comprised between the traveller and the pigtail.

Conventional travellers which generally present a "C" or "J" shape and are molded, for example, from a synthetic polymer such as polyamid, are subdivided according to their mass which may range between a few tens and several thousands of milligrams.

In fact, all other things being equal, the mass determines the centrifugal force imposed upon the traveller.

It has been found that a fraction, for example $\frac{1}{3}$, of said centrifugal force contributes to warrant a suitable tension of the thread to be twisted and that the balance, namely $\frac{2}{3}$, causes pressures and frictions at the traveller/guide ring, respectively traveller/ thread to be twisted contact surfaces, by creating relatively high specific pressures which may exceed the resistance of the materials in contact with each other. In particular, this latter inconvenience appears in the case of twisting of heavy threads, exceeding approximately 10,000 deniers, which require high thread tension.

To decrease excessive specific pressure on the thread to traveller contact surface, said contact surface can be enlarged but at the cost of increased friction of the traveller on its guide ring which results in a reduction of the traveller rotational speed and consequently in a reduced profitability of the frame. As an example, it can be said that when the weight of a traveller passes from 3 to 4 g, its speed decreases by 20 to 25 percent.

The invention aims to dissociate the friction between the traveller and the threadlike element from the effect of the traveller's mass by the use of a traveller with a roller of a specific shape and spatial arrangement.

Roller travellers have already been described previously; see U.S. Pat. No. 2,942,407 and German Application DOS No. 1,560,316.

Roller travellers according to said publications have in common the presentation of an accentuated groove either in the roller mass itself or by means of lateral flanges aimed to oppose a lateral escapement of the thread.

In the first case, the thread, circumnavigating the roller in correspondence with the seizure angle, successively encounters, on the periphery of the roller points located at different diameters and consequently moving at diverging linear speeds. This results in a differential speed, with increase in friction, the consequence of which is a risk of superficial damage to threads. Moreover, roller travellers according to prior art, due to the lateral cheeks of the groove or the flanges, prevent the thread from finding under any circumstances its position of equilibrium on the roller. It is known that this position of equilibrium varies according to the position - high or low - of the traveller with respect to the spool and also according to the degree to which the spool is filled.

The stresses imposed upon the thread express themselves in additional friction unless, as in the case of the above DOS, adjustable rollers are provided. In this manner, it is possible to reduce the friction between the thread and the roller of the traveller, but at the price of an increased weight of the latter, which is to the detriment of its possible rotational speed on the guide ring and, thus, of the productive capacity. Moreover, vibrations with the risk of projecting splinters, which endanger the safety of the personnel, can often be observed.

In addition, travellers with adjustable rollers do not present a symmetrical plane so that different rollers must be provided for the "Z" and "S" directions of twist.

The object of the present invention is to make available a roller traveller which avoids the inconveniences of roller travellers according to the prior art. In particular, the invention deals with a roller traveller on which the thread to be twisted or doubled finds, under all circumstances, its position of equilibrium without resulting additional frictions by a variation in the differential speed between the thread and the roller at successive points of contact between these two elements.

According to the invention, these objects are attained by a roller traveller of which the roller has substantially cylindrical configuration and presents a ratio length (L) to diameter (D) superior to one-half and preferably comprised between 1 and 2.

The diameter (D) of the roller is selected in function of the thickness (d) of the thread submitted to twisting in such a manner that $D:d \geqq 3$ and preferably $5 < D:d < 10$.

As regards the angle of inclination of the roller axis on the spindle axis, the research which has lead to the present invention has shown that this angle advantageously exceeded 30 degrees and was preferably comprised between 45 and 60 degrees.

Between these limits, the force acting through the intermediary of the thread on the roller, actually produce such a tilting moment that the traveller can slide on the guide ring under good conditions of stability which are necessary to oppose the forces of acceleration and deceleration which results from the elasticity of the thread to be twisted.

The roller will, thus, be mounted on the traveller while taking into account the inclination of said traveller on the spindle axis when the traveller is in working position on the guide ring.

Distinction can be made between different types of guide rings depending on the orientation of the radially interior support surface offered to the traveller: cylindrical rings, so-called "vertical" rings with a radially interior support surface which is substantially parallel to the spindle axis, conical rings with a radially interior support surface which is inclined on the spindle axis, and toroidal rings with a toroidal support surface.

In the first case, the angle of inclination of the roller on the spindle axis, indicated above, corresponds to angle $\alpha$ between the roller axis and the radially interior support face of the traveller on the guide ring. In the second case, and assuming that the ring presents a conicity corresponding to an angle at the top $2\beta$, angle $\alpha$ must be superior to 30 degrees $+\beta$ and preferably comprised between 45 degrees $+\beta$ and 60 degrees $+\beta$. In the case of a toroidal ring, the orientation of the roller axis on the traveller will also be determined in a manner to correspond to angles of inclination superior to 30 degrees and preferably comprised between 45 and 60 degrees on the spindle axis, in working position.

The mounting of the roller on the traveller is illustrated by an example on the attached drawings, in which:

FIG. 1 is a partial sectional view of a roller traveller according to the invention, of "C" type, mounted on a ring with a cylindrical support surface;

FIG. 2 shows also a partial sectional view of a traveller according to the invention on a conical ring.

On these figures, similar elements are identified by the same references.

According to FIG. 1, a traveller 1 slides on a ring 2 under the action of the advance of the thread 3 in the direction of the arrow towards a combined spool and spindle, not shown, of the axis 0–0'. The traveller has at the top and on the inside of its hook end a roller 4 shown in a sectional view according to an axial plane, on an axis 5. The traveller 1 is of the type "C" in polyamid. The axis 5 of the roller 4 is anchored in the mass of the traveller by means of injection of the polyamid in a suitable mold around the axis-roller assembly. The roller is made of a material presenting a high resistance to temperature and abrasion. This material can be, for example, a metal alloy, polyimid, or other suitable organic or inorganic materials. The radially interior support surface of the traveller is indicated by 6. Since the drawing is concerned with a so-called "vertical" ring, namely a ring of which the radially interior support surface presented to the traveller is parallel to the 00' axis of the spindle, the angle $\alpha$ between the axis 5 and the support face 6 is equal to the angle of inclination of the axis 5 on the 00' axis of the spindle. In the case of FIG. 1, this angle is of 50 degrees. In the case of FIG. 2, the angle of inclination of the axis 5 on the axis 00' is still of 50 degrees. However, the angle of inclination between said axis 5 and the support face 6 is increased by the value of the inclination $\beta$ of said support face on the axis 00'.

When the thread to be twisted is especially abrasive with respect to the wear resistance of the material of the roller traveller, it can be of advantage, for the purpose of warranting a uniform wear of the roller, to give to the revolutional surface which forms the envelope of the latter, a slightly concave configuration. However, to prevent the above-mentioned inconveniences of rollers with accentuated grooves, it is necessary not to exceed in this case a ratio of maximum diameter to minimum diameter of the envelope of approximately 1.15. Above this value, the unfavorable actions of the increased friction exceed the advantages of a more uniform wear. On the other hand, it is desirable that the margin between the maximum diameter and the minimum diameter of the envelope does not exceed the value of the radius of the section of thread submitted to twisting.

EXAMPLE

On a conventional frame with a vertical ring is doubled a thread of 15,560 deniers, formed by a multifilament of 5 strands pretwisted at a twisting rate of 273 T per m. The rate of twist of the final cord is 546 T per m.

A guide ring with a 220 millimeter diameter is used. The thread tension oscillates between 150 and 300 g due to elasticity phenomena. To allow comparison, a conventional "C" type traveller weighing 3000 mg is used on one hand, and on the other hand, a traveller of the same weight according to the invention comprising the top and inside the "C" a roller out of light metal alloy, mounted in a manner to present an inclination of 50 degrees with respect to the radially interior support face of the traveller. The roller has a cylindrical envelope 6.5 mm long and with a 5.5 mm diameter. In the case of the conventional traveller, the speed of maximum possible rotation of the spindle did not exceed 2150 revolutions per minute.

Thanks to the use of a roller traveller according to the invention, this speed could be increased without inconvenience, in particular for the uniformity of the cord, to 2900 revolutions per minute.

What is claimed is:

1. A roller traveller for a twisting frame useful for twisting threads, in particular heavy threads exceeding 10,000 denier, the improvement therein comprising a roller having a substantially cylindrical outer surface the length to diameter ratio of which surface exceeds one-half; said roller being rotatably mounted in said traveller to engage a thread being acted on by said traveller, the traveller having a hook portion, means providing an axis fixed in said hook portion mounting said roller for rotation about said axis, said axis lying at an angle between 30° and 60° with respect to a line perpendicular to the plane of travel of said traveller.

2. A roller traveller as claimed in claim 1 wherein said length to diameter ratio is between 1 and 2.

3. A roller traveller as claimed in claim 1 wherein said surface is of a diameter of from 3 to 10 times the diameter of the thread acted on by said traveller.

4. A roller traveller as claimed in claim 1, the traveller having a guide ring engaging surface extending parallel to said line.

5. A roller traveller as claimed in claim 1, the traveller having a guide ring engaging surface extending angularly with respect to said line at an angle beta therewith.

6. A roller traveller as claimed in claims 1, 2, or 3 wherein said axis lies in a plane normal to and containing the axis of the path of travel of said traveller about a spindle of said twister frame, whereby the traveller is useful independently of the rotation direction thereof about such spindle to effect selectively an S -or a Z-twist in said thread.

* * * * *